United States Patent [19]

Kramer et al.

[11] Patent Number: 4,583,337

[45] Date of Patent: Apr. 22, 1986

[54] FLAT ROOF STRUCTURE

[75] Inventors: H. Carl B. Kramer; Hans-Joachim Gerhardt, both of Aachen, Fed. Rep. of Germany

[73] Assignee: The Dow Chemical Company, Midland, Mich.

[21] Appl. No.: 737,610

[22] Filed: May 24, 1985

[30] Foreign Application Priority Data

May 25, 1984 [DE] Fed. Rep. of Germany ..... 3419658

[51] Int. Cl.[4] ..... E04H 12/28

[52] U.S. Cl. ..... 52/302; 52/408; 52/199

[58] Field of Search ..... 52/62, 302, 303, 408, 52/409, 410, 801, 199

[56] References Cited

U.S. PATENT DOCUMENTS

| | | | |
|---|---|---|---|
| 3,307,306 | 3/1967 | Oliver | 52/409 |
| 3,817,009 | 6/1974 | Elder | 52/199 |
| 3,892,899 | 7/1975 | Klein | 52/408 |
| 4,506,483 | 3/1985 | Phalen | 52/408 |

*Primary Examiner*—Henry E. Raduazo
*Assistant Examiner*—Dan W. Pedersen

[57] ABSTRACT

An improved flat roof structive is provided comprising a substructure and a plurality of insulating elements which are loosely positioned on the substructure. A corrugated cover member of a substantially rigid material is positioned on the insulating elements at least in an area adjacent the outer perimeter of the roof. The corrugated cover member has downwardly facing channels which extend in a direction generally from an outer perimeter towards the center of a roof. The channels are open at their ends facing the perimeter of the roof and are closed or sealed at their ends facing toward the center of the roof. A strong air flow will create a vacuum under the cover member in wide areas which reduction is greater than the vacuum on the upper surface of the cover member whereby the cover member is pressed downwardly against the insulating elements. Due to the nearly uniform vacuum under the cover member, i.e. on the upper surface of the insulating elements, the resultant force which acts in the direction of lift-off on the insulating elements is nearly zero.

9 Claims, 4 Drawing Figures

FLAT ROOF STRUCTURE

BACKGROUND OF THE INVENTION

The present invention broadly relates to a flat roof comprising a substructure, panel-shaped elements which are laid loosely on the substructure, and corrugated cover members positioned on the panel-shaped elements.

According to the general definition, the term "flat roof" designates roofs having a maximum slope of about 20 degrees with reference to a horizontal plane.

The surface of a flat or slightly sloped roof, i.e. more generally of a "flat roof", belong to those roofs having surfaces on which the flow of air, i.e., wind, can produce the greatest vacuum or sub-atmospheric pressure. The absorption and deflection of the wind force, which acts upon the flat roof due to the creation of a vacuum and which force is directed to a lift-off of the roof structure becomes more difficult the lighter the weight of the roof structure.

In the case of a flat roof having a light weight substructure, or in the case of an old flat roof, an improvement in the thermal insulation oftentimes is highly desirable if not required. For such a roof, an additional layer of thermal insulating material can be applied. The thermal insulating material layer generally consists of individual panels of a suitable thermal insulating material. Depending on the substructure, the individual panels can be mechanically secured to the substructure of the roof, albeit in a labor-consuming manner.

However, the possiblity of a mechanical attachment to the above described type of flat roof is excluded for a so-called "upside-down roof" which has a moisture and vapor resistant barrier membrane placed below the layer of thermal insulating panels. Such an upside-down roof has the great advantage that the thermal insulation layer simultaneously serves as protection for the barrier membrane which ordinarily consists of a relatively fragile sheet or film, for example of a synthetic resinous material. The thermal insulation panels are coated with a cementitious material or mortar, or are covered by a layer of gravel, concrete blocks or panels on their upper surfaces to protect them from UV-radiation. Lapped joints may be provided between the individual insulation panels to allow some pressure compensation between the upper and lower sides of the panels. This pressure compensation is better, the more similar the external distribution of pressure on the roof surface becomes to a linear distribution. At a constant external distribution of pressure, during gusts of wind, equalization of pressure is practically complete such that the resulting wind gust loading of the insulation panels is nearly zero. However, in areas adjacent to or near the outer perimeter of the roof this external pressure distribution is not linear. In these peripheral areas, the large resulting wind loads inevitably cause a lift-off of light-weight insulation panels if they are not reliably secured to the substructure of the roof by locking or securing members or by a frictional connection. In principle, the problem could be solved by application of an additional load, for example by an increase in the amount of gravel or by application of a layer of concrete of sufficient increased thickness on the insulation panels. However, such an additional load is not possible for roofs of light construction or for roofs the carrying capacity of which is already at its limit, e.g. for an old roof construction which is in need of retrofitting with an upside-down roof. Furthermore, the retention of gravel in the critical areas of the roof is not always assured due to movement of the gravel caused by wind and rain.

SUMMARY OF THE INVENTION

Accordingly, it is an object of the present invention to provide a flat roof comprising a substructure having light-weight insulating panels loosely positioned on the substructure and in which the insulating panels are secured against lift-off by means of corrugated cover members even when an extreme external pressure distribution, caused by a strong wind or wind gust, exists which acts in a direction causing a lifting-off of the insulating panels.

More particularly, the invention resides in a flat roof comprising a substructure, panel-shaped elements loosely positioned on the substructure, and corrugated cover-members of a substantially rigid material positioned on the panel-shaped elements at least adjacent to an outer peripheral region of the roof, said corrugated covering members having channels which extend from an outer perimeter of the roof towards the center portion of the roof, and wherein said channels form downwardly facing portions which are open at their ends facing towards the outer perimeter of the roof and which are closed at their ends facing toward the center portion of the roof.

The advantages provided by the present invention are particularly based on a zone of pressure equalization originating between the bottom surface of a corrugated cover member and an upper surface of the panel-shaped thermal insulating elements in which zone a nearly constant subatmospheric pressure zone or vacuum is created during periods of increased airflow, i.e. during periods of wind storms or gusts. The magnitude of the vacuum depends on the external vacuum on the upper surface of the layer of cover members near the perimeter of the roof. Accordingly, a vacuum created under the cover member is in large areas greater than the vacuum on the upper surface of the cover member, i.e. due to the pressure differential the cover member is pressed onto the underlying insulating panels. Because the pressure is nearly constant across the upper surface of the insulating panels, the resulting wind load on the insulating panels is nearly zero. Accordingly, the insulating panels cannot be lifted, even at high wind speeds. The higher the speed of the wind, the greater becomes the vacuum or subatmospheric pressure between the cover member and the underlying insulating panels, i.e. the greater also become the forces which press the cover member and the insulating panels against the substructure of the roof.

If desired, the cover members can be fixed with respect to the roof structure by any additional, mechanical securing means which, for example, can be positioned at the corners of the flat roof. In such case, care must be taken that the sensitive barrier membrane of the upside-down roof is not damaged.

DESCRIPTION OF THE DRAWINGS

The invention will now be explained in greater detail wih reference to the accompanying drawings in which.

DETAILED DESCRIPTION OF THE INVENTION

Figure 1:
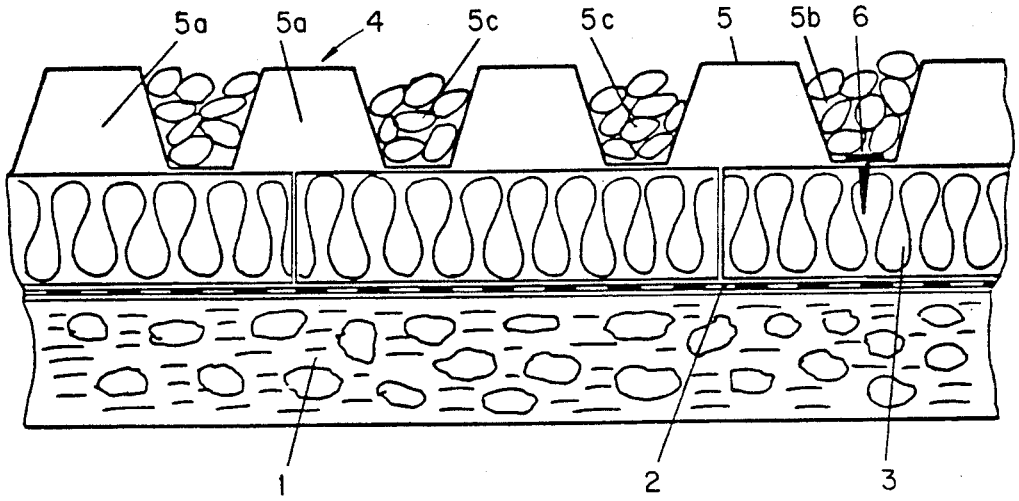
FIG. 1 is a vertical cross-sectional view of a flat roof, specifically, an upside-down roof.

FIG. 1 illustrates schematically the general construction, in cross-section, of a flat upside-down roof. A layer of a roof sealant or sealing compound is applied or laid on a roof substructure 1. The layer of roof sealant 2 generally consists of a layer of an elastomeric material such as, for example, a sealing compound of a rubber or latex based material, or a sheet or film of a synthetic resinous material. Thermal insulation panels (3) are laid on top of the roof sealant (2).

A layer of corrugated cover members (4), is positioned on top of the insulating panels (3) such that the corrugations in the cover members extend in a direction perpendicular to the width of the cover members. The cover members serve the purpose of holding the insulating panels (3) in position on the roof substructure. Each of the cover members (4) is provided with channel-shaped deformations or grooves (5*a*) which are shown in cross-section in FIG. 1. In a preferred embodiment, the cross-section of the channels or grooves in FIG. 1 are trapezoidal. Other cross-sectional shapes are useful as well. However, periodically recurring channels should exist which are open in a downwardly facing direction, i.e. open toward the roof substructure (1) and the roof seal (2) and which are closed upwardly.

The channels (5*a*) are open in a direction facing the insulation panels (3) and should have a cross-section sufficiently large to allow for an unhindered run off of moisture or liquid or a diffusion of vapour from above the roof substucture. As illustrated by FIG. 1, the channels (5*a*) form grooves (5*b*) between the channels which are open in an upwardly facing direction. These grooves (5*b*) are filled with a ballast such as gravel (5*c*), or the like, the weight of which additionally secures the position of the insulating panels. When gravel is used, the grooves (5*b*) also prevent movement of the gravel due to wind or rain. Such movement inevitably takes place on conventional gravel-covered flat roofs in which gravel of the same granular size is used.

Figure 4:
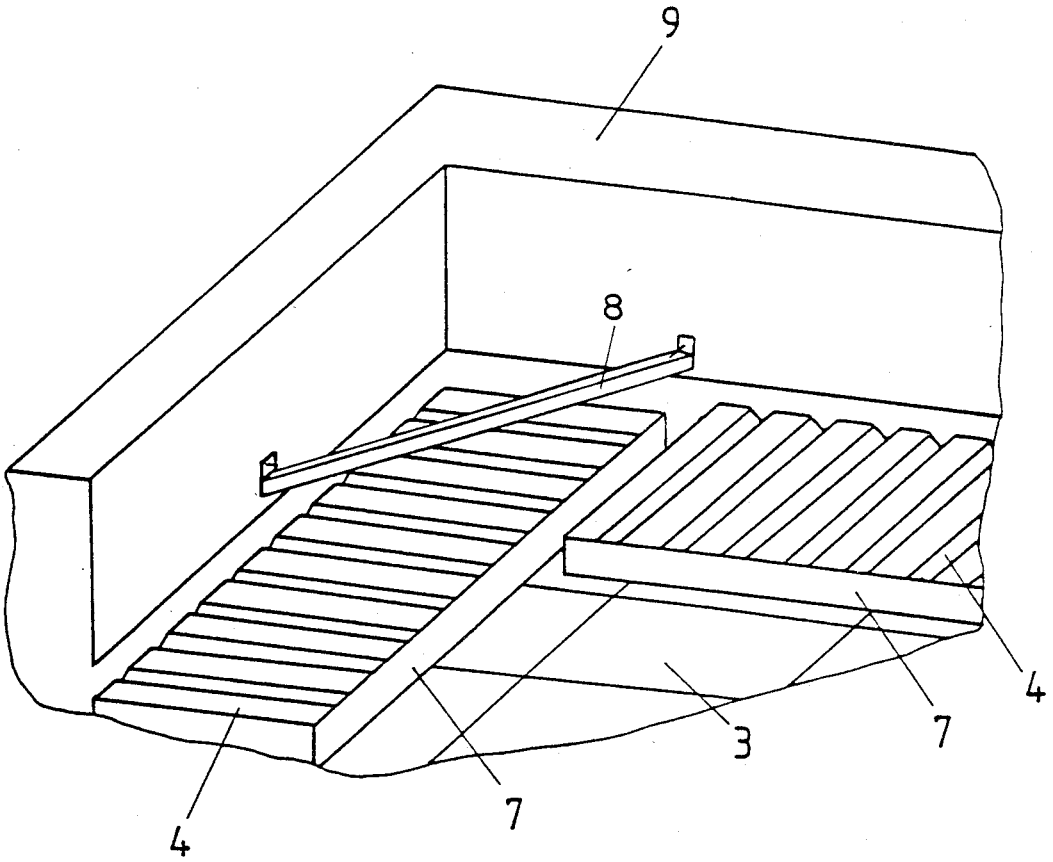
FIG. 4 is a perspective view of a corner of a flat roof.

FIG. 4 is a perspective view of an upper surface of a corner of a flat roof comprising a layer of corrugated cover members (4). The roof is surrounded by a parapet (9). The central area of the roof is covered only by the insulation panels (3) which are loosely positioned on top of the roof sealing layer 2, not shown. Along the perimeter of the roof, i.e. adjacent to the parapet (9), the corrugated cover members (4) are arranged such that the channels (5*a*) and the grooves (5*b*) extend in a direction perpendicular to the perimeter of the roof or parapet and in a direction generally towards the center of the roof. The cover members are positioned such that the open ends of the channels (5*b*) are adjacent the perimeter of the roof whereas the ends of the channels facing towards the center of the roof are sealed or closed by means of a sealing element or closure (7).

The corrugated cover members (4) can be secured to the roof substructure by means of a fastening member such as nails, screws, or the like, as illustrated by reference member (6) in FIG. 1. For this purpose, the fastening member (6) can be driven through the bottom of a groove (5*b*) of a cover member 4 into an underlying insulation panel (3). The fastening forces caused therby are generally sufficient for preventing movement of the cover member (4).

In exceptional cases such as, for example, in the case of a very high building and a very large roof surface, a form-fit fastening of the layer of corrugated cover members (4) can be provided in the corners of the roof by a rod, bar, or the like, which is attached to the inner walls of the parapet (9) or to the border of the roof. The rod (8) can be made of, for example, metal, wood, or a synthetic resinous material. The rod (8) is laid on the upper side of the layer of corrugated cover members (4) and thereby maintains the layer (4) in position on the roof substructure.

As illustrated by FIG. 4, a layer of the corrugated cover members (4) is laid at a distance from the outer perimeter of the roof or from the inside edge of the parapet, so that a gap is formed (measured perpendicularly to the roof perimeter) between the roof perimeter or parapet on one side and the cover members (4) on the other side which gaps should be narrow compared to the width of the cover members (4) themselves. Generally, the width of the cover members (4) should amount to at least five times the width of this gap.

The corrugated cover members (4) can be made of any suitable material such as, for example, a sheet of metal or a synthetic resinous material.

Figure 2:
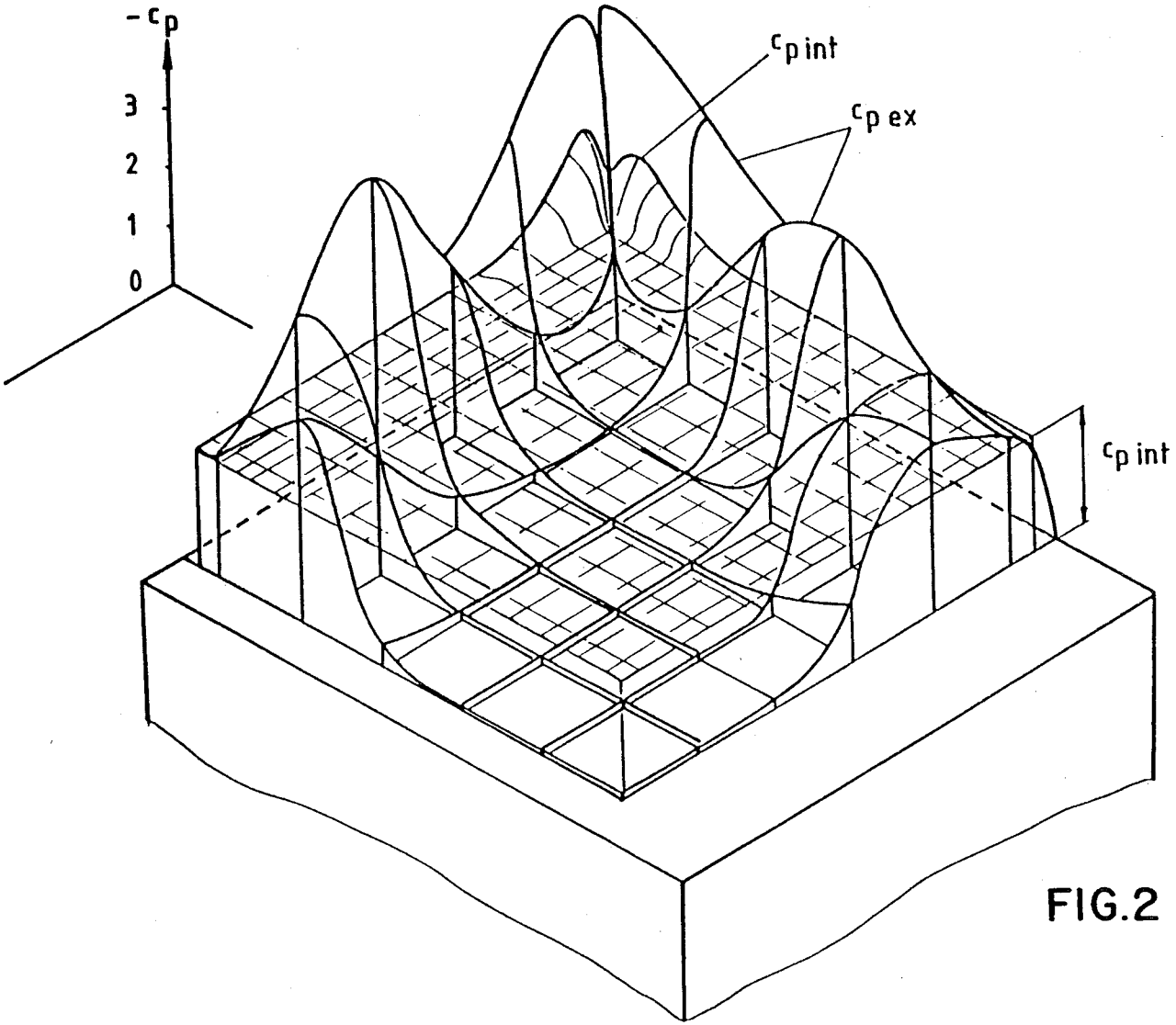
FIG. 2 is a graphic presentation of an external pressure distribution ($c_{p\,ex}$) above a corner area of a flat roof and of the pressure distribution ($c_{p\ int}$) under a layer of the corrugated cover members.

The mode of operation of a layer of the corrugated cover members will how be described with particular reference to FIG. 2 wherein a corner of a flat roof is taken into consideration. The edges of the corner are 0.1 B units long, based on a width B of the entire surface of the roof. The air pressure distribution above this corner illustrates that substantial subatmospheric pressure can exist, especially near the perimeter of the roof. If, in the corner of the roof, a layer of the corrugated cover members (4) is placed on top of the insulation panels (3), and if the channels of the cover members (4) are closed at their inner ends, i.e. towards the center of the roof, and are open in a direction facing the perimeter of the roof, a nearly constant vacuum occurs in the volume which is essentially bounded by the channels (5*a*) which are open in a downwardly facing direction. This vacuum depends on the external pressure distribution near the roof perimeter. Accordingly, the vacuum is, over large areas of the roof surface under the cover members (4), higher than above the cover members. Thus, the harder the wind blows, i.e. the greater the air speed and pressure, the greater the vacuum, i.e. subatmospheric pressure, on the roof surface and correspondingly, the greater the vacuum (subatmospheric pressure) underneath the cover members (4). Therefore, it is surprising, but due to the foregoing physical explanations an understandable, phenomenon that the layer of cover members is better protected from lift-off the higher the wind-created suction forces are near the roof surface. Furthermore, the position of the insulation panels is secured since the pressure on their upper surfaces is maintained nearly uniform.

As illustrated in the perspective view of FIG. 2, the suction coefficient $c_p$ int is about minus 2 under the cover member (4), i.e. in the predominate part of the corner of the roof, a vacuum or subatmospheric pressure is generated which is greater than the vacuum or pressure on the outer surface of the cover member.

Figure 3:
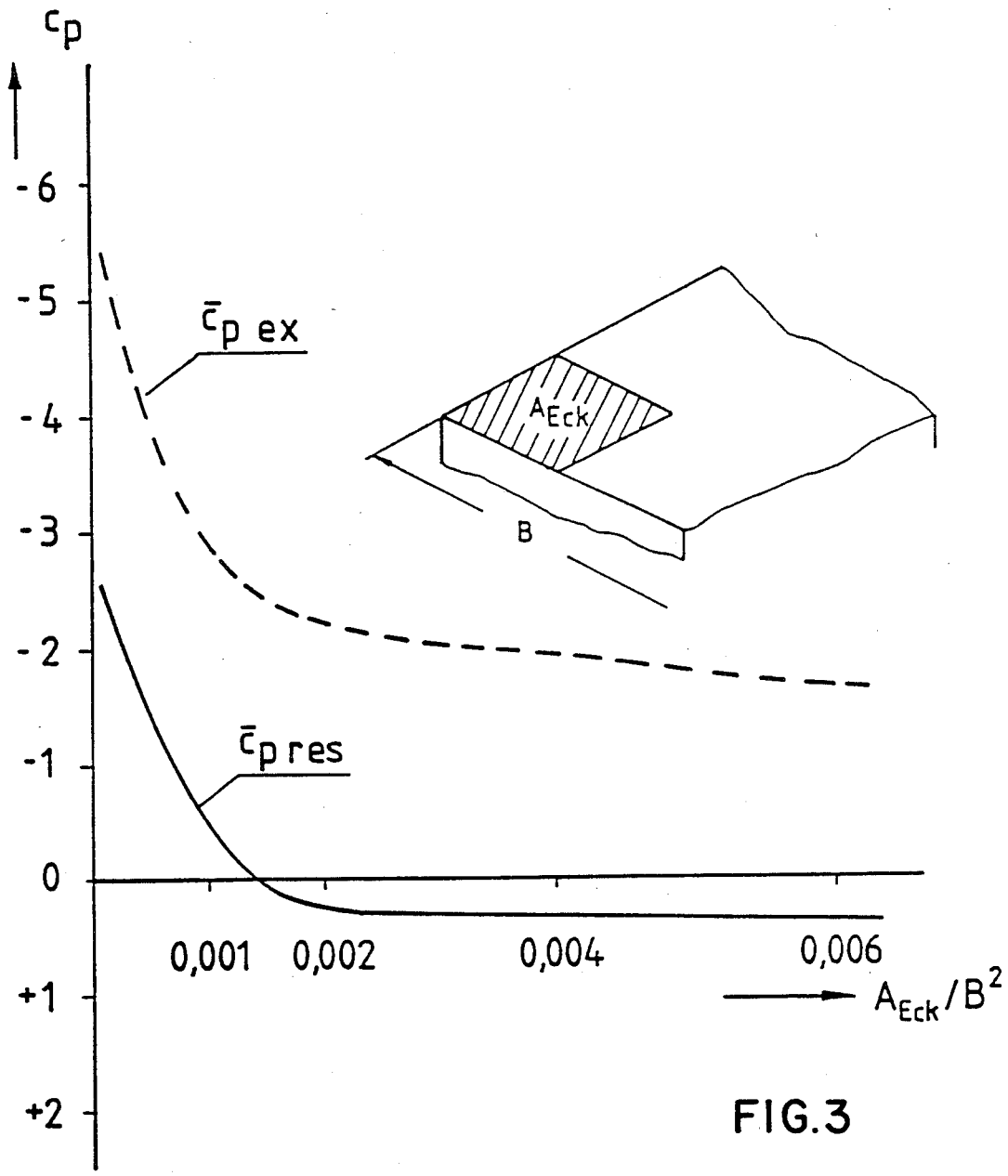
FIG. 3 is a graphic diagram of the lifting forces of air pressure, represented as the change of the pressure coefficient $c_p$ of the pressure above the standard area of a portion of the surface of the flat roof. One curve ($\bar{c}_{p\ ex}$) relates to a common unprotected roof surface and the other one ($\bar{c}_{p\ res}$) relates to a roof surface protected by a corrugated covering layer.

This behaviour is more clearly shown in the graph of FIG. 3 which illustrates the coefficients for the external pressure $\bar{c}_{p\ ex}$ which exists on a flat roof in the corner area of an unprotected roof surface (broken curve) and for the resultant pressure $\bar{c}_{p\ res}$ on a roof surface covered by a layer of cover members (4) (solid line). The values $\bar{c}_{p\ ex}$ and $\bar{c}_{p\ res}$ were obtained by wind tunnel measurements on a model of correct scale. In the fashion the mean values of pressure coefficients $\bar{c}_{p\ ex}$ and $\bar{c}_{p\ res}$ have been calculated for a square corner surface ($A_{eck}$) of which the length of the edges is varied from 0 to 0.06 B. The building had a rectangualr cross section (width B).

FIG. 3 shows that the resultant force is directed downwardly if the corner area is larger than 0.0015 $B^2$. Accordingly, it is sufficient to secure a relatively small area by means of a layer of the corrugated cover members (4).

Due to the relatively high flexural strength of the cover members (4), to which the channel-shaped grooves also contribute, the load acting in the direction of lift-off above a relatively small area can be compensated by the load directed downward which acts upon the rest of the cover members.

According to the embodiment of FIG. 4, the height of the parapet of the flat roof is a multiple of the height of the corrugated cover member (4). While not mandatory, an optional parapet on the perimeter of the roof should be higher than the upper surface of the cover member (4).

What is claimed is:

1. A flat roof comprising a substructure, panel-shaped insulating elements loosely positioned on the substructure, and at least one corrugated cover member of a substantially rigid material positioned on the insulating elements at least adjacent to an outer peripheral region of the roof, said corrugated cover member having channels, and said cover member being positioned on the insulating elements such that the channels extend in a direction from an outer perimeter of the roof towards the center portion of the roof, and wherein said channels form downwardly facing portions which are open at their ends facing toward the outer perimeter of the roof and which are closed at their ends facing toward the center portion of the roof.

2. The roof of claim 1 wherein the channels have a regular cross-section.

3. The roof of claim 2 wherein the channels have a trapezoidal cross-section.

4. The roof of claim 1 wherein the cover member has grooves which open upwardly and which are filled with a load preferably gravel or crushed stone.

5. The roof of claim 1 wherein the width of the cover member is greater than five times the width of the gap between the edge of the roof, especially a parapet around the perimeter of the roof, and the respective longitudinal edge of the corrugated covering layer.

6. The roof of claim 1 wherein the outer peripheral edge of the roof is provided with a parapet, and wherein the height of a parapet is at least the height of the cover member.

7. The roof of claim 1 wherein the cover member is held in position on the insulating elements by mechanical fastening means at least in the areas of the corners of the roof.

8. The roof of claim 6 wherein the cover member is held in position on the insulating elements by mechanical fastening means at last in the areas of the corners of the roof.

9. The roof of claim 6 wherein securing means is provided in the areas of the corners of the roof for securing the cover member and wherein said securing means is attached to the parapet.

* * * * *